United States Patent [19]

Rünzi

[11] Patent Number: 4,620,809

[45] Date of Patent: Nov. 4, 1986

[54] DUAL SHEET FEEDER FOR TYPEWRITERS OR OUTPUT PRINTERS

[76] Inventor: Kurt Rünzi, Küsnachterstr. 59, CH 8126 Zumikon, Switzerland

[21] Appl. No.: 716,196

[22] Filed: Mar. 26, 1985

[30] Foreign Application Priority Data

Apr. 2, 1984 [CH] Switzerland ..... 1665/84

[51] Int. Cl.[4] ..... B41J 11/58

[52] U.S. Cl. ..... 400/624; 400/605; 400/629; 271/9

[58] Field of Search ..... 400/605, 607, 607.3, 400/608.2, 608.3, 608.4, 624, 625, 629, 630, 634, 636; 271/9, 21, 109, 114, 116

[56] References Cited

U.S. PATENT DOCUMENTS 4,222,557 9/1980 Wu ..... 271/9
4,416,559 11/1983 Steinhilber ..... 400/629

FOREIGN PATENT DOCUMENTS 2910849 9/1980 Fed. Rep. of Germany ..... 400/629
2950707 9/1980 Fed. Rep. of Germany ..... 400/625
58-17031 2/1983 Japan ..... 271/9
638436 12/1978 Switzerland .

*Primary Examiner*—Edgar S. Burr
*Assistant Examiner*—David A. Wiecking
*Attorney, Agent, or Firm*—Frishauf, Holtz, Goodman & Woodward

[57] ABSTRACT

Different copy elements, such as letterheads, unprinted sheets, envelopes or the like can be fed from different supply stacks (2, 3; 3*a,* 3*b,* 3*c*) by individual separating rollers (7, 8) which frictionally engage the uppermost of the copy elements of the respective stacks. The copy elements are fed into the gap between a platen (10) of the printer, and then deposited on an output stack. The selection of the copy element from the specific stack (2, 3 for example) is obtained by different angles of rotation of the platen, in reverse—that is, counter to the sheet feeding direction—to thereby, selectively, engage different ratchets and ratchet wheels of a coupling connected to the respective separating rollers which feed the copy elements from the respective stacks.

15 Claims, 12 Drawing Figures

DUAL SHEET FEEDER FOR TYPEWRITERS OR OUTPUT PRINTERS

Reference to related publication: Swiss Pat. No. 638,436.

The present invention relates to a sheet feeding apparatus for use with office machines, such as typewriters, computer or word processor output printers and the like, and more particularly to a sheet feeding apparatus which has the capability of, selectively, feeding sheets from more than one supply stack, as desired. For example, one supply stack may carry sheets with an organizational letterhead, another supply stack may carry bill or invoice heads, and yet another supply stack may carry envelopes. The material in the various stacks, for simplicity, will hereinafter be referred to as "sheets" or "copy materials", respectively. The apparatus is versatile and may be used with only a single stack of copy material, and it is so arranged that it can, on demand, be expanded further for subsequent attachment of holders to feed from additional stacks of copy material.

BACKGROUND

It has previously been proposed—see the referenced Swiss Pat. No. 638,436—to supply single sheets or copy material from a stack to a platen of a writing or printing type office machine, such as a typewriter, an output printer, a word processor printer or the like. A separating roller engages the topmost sheet or copy material from a stack and supplies it to an input slit between the platen and a counter roller, or counter surface. The separating rollers frictionally engage the top sheet and are coupled over a free wheeling, or overrunning clutch arrangement to gearing, so that, when the gearing is driven, the sheet is fed; when the sheet is grasped by the driven platen, the separating rollers can run freely, not requiring any further drive, or, if the drive for the separating roller continues to operate, the separating rollers can overrun the drive speed of the drive to the separating rollers; that is, they can freely operate at the higher speed. The gearing, or drive arrangement for the separating roller can receive drive powered directly from the platen of the typewriter, printer or the like which, for simplicity, may be referred to hereinafter as a "printer".

One known arrangement utilizes a printer platen which, in order to feed a sheet, first rotates in a direction counter to the sheet feeding direction. Such counter rotation, which may also be used for alignment of a sheet, will be referred to as the "reverse" or "sheet aligning direction" of rotation of the roller. To feed a sheet, the platen, then rotates first in the sheet aligning or reverse direction over a predetermined angle of rotation; thereafter, it rotates forwardly, or in the sheet feeding direction, for a certain angular distance, which may be small. Thereafter, the platen again reverses, and operates in reverse, or sheet aligning direction, for a predetermined distance, and until the sheet reaches the gap between the platen and a first pressure roller, so that the sheet can then be grasped. The platen then again reverses and pulls the sheet into the printer by rotation of the platen in the sheet feeding, or forward direction.

The sequential operation, first forwardly—for example to eject a previously printed sheet—then reversely by a predetermined angle, then forwardly by a second predetermined angle, then again reversely, and then again forwardly requires a relatively expensive and complex ratchet and direction sensing apparatus as well as programming of an office machine, such as a word processor, computer output printer or automatic or semi-automatic typewriter.

THE INVENTION

It is an object to provide a sheet feeding apparatus which avoids the necessity of repetitive reverse and forward rotation of the platen, and which is simple and reliable; and which, additionally, permits feeding copy material from various stacks, preferably expandable as to the number—so that, for example, different preprinted copy material may be handled by the printer.

Briefly, a drive arrangement is coupled through the separating rollers, the driving arrangement including gearing with an overrunning clutch, as generally known. The drive arrangement is driven from a coupling element which is engaged with the platen by a slip-free rotation transmitting coupled arrangement.

In accordance with a feature of the invention, the gearing includes means to sense the angular extent of rotation of the coupling element when the platen operates in the reverse, or sheet aligning direction; the separating rollers are then driven after the reverse rotation, over a predetermined angle after reverse rotation has been sensed and upon subsequent rotation of the platen in the forward, or sheet feeding direction. Rotation of the coupling element, with the platen, over at least a limited angular extent in the direction controlled by the then forwardly rotating platen, that is, the platen which is operating in the sheet feeding direction.

The arrangement has the advantage that the platen need reverse only once, and the mechanism can be simplified. By associating different predetermined angles over which the coupling means rotates with a positioning discontinuity such as different supply stacks, the angular extent of rotation—derived by the angular rotation of the platen—can be used to control the selection of the stack from which the copy material will be fed. Thus, by a simple programming step of controlling angle of rotation of the platen—in reverse direction—a selection can be made if the copy material to be supplied to the printer is, for example, a letterhead, or an envelope.

DRAWINGS, which illustrate:

FIG. 1, a schematic cross section taken through the apparatus;

FIG. 2, an exploded perspective view of the apparatus with the intermediate frame and the printer;

FIG. 3, a side view of the apparatus;

FIG. 4, a section taken along the line IV—IV of FIG. 3;

FIG. 5, a schematic view of the gearing in the initial position;

FIG. 6, a schematic view corresponding to FIG. 5, but with a coupled right wheel;

FIG. 7, a schematic view according to FIG. 5 with the right wheel being rotated;

FIG. 8, a schematic side view of a second embodiment;

FIG. 9, a section taken along the line IX—IX of FIG. 8;

FIG. 10, a section taken along the line X—X of FIG. 9; and

FIGS. 11 and 12, a schematic illustration of the feeding of paper at the platen 10.

DETAILED DESCRIPTION

Figure 1:
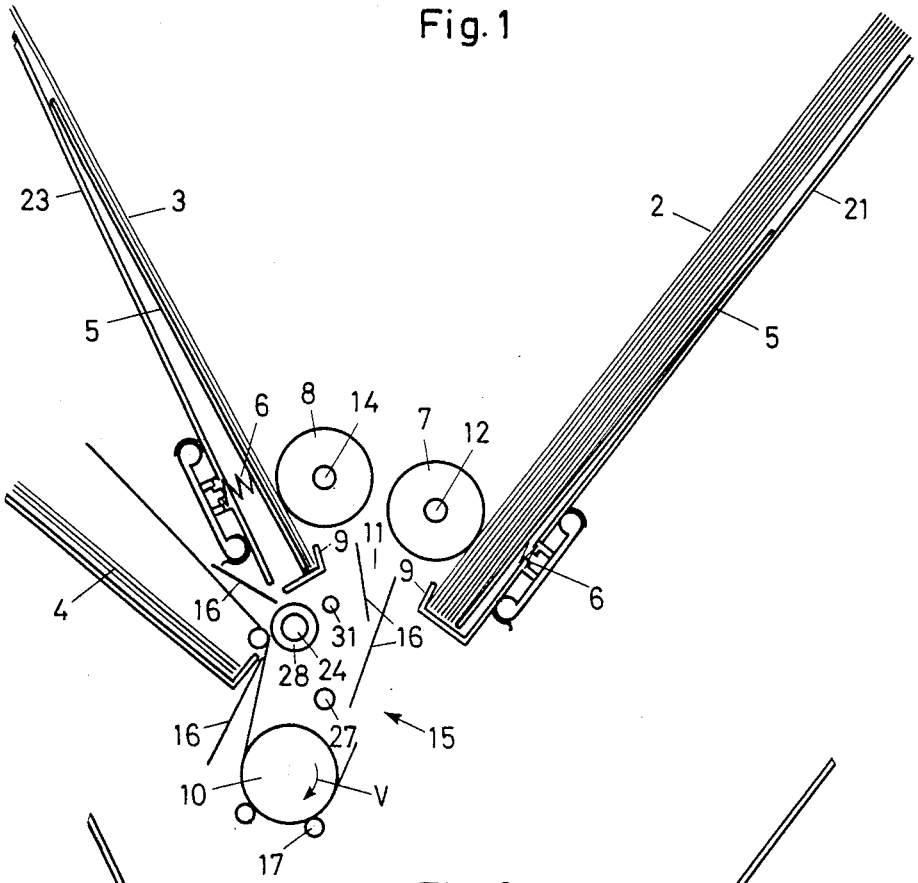
Figure 3:
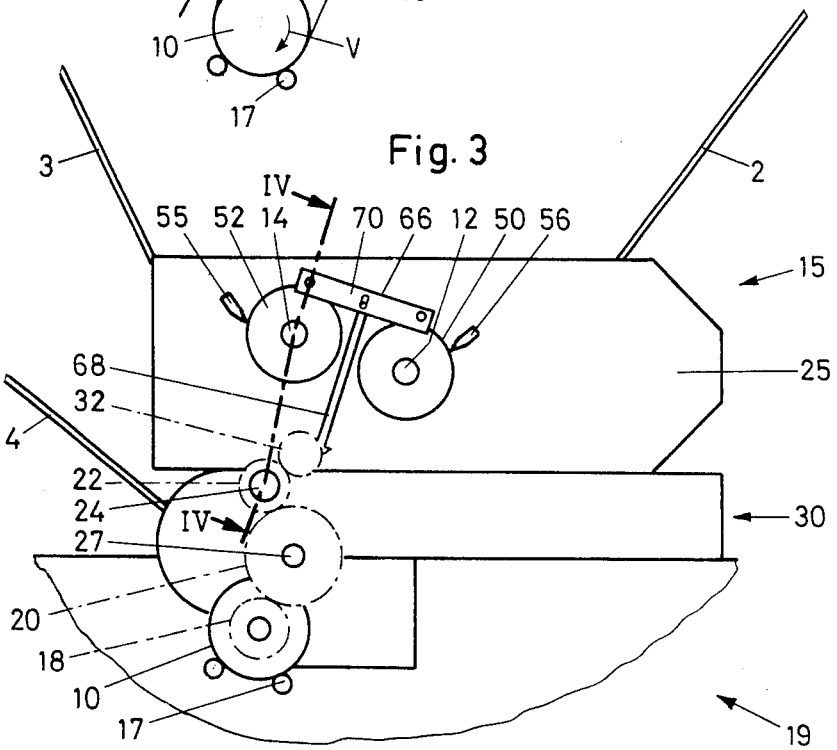

The apparatus is used to feed sheets or copy material selectively from a first supply stack 2 or a second supply stack 3 to an office machine 19, for instance a typewriter or printer. These sheets are then guided around the platen 10 and when they leave the platen they are placed on an output stack 4. The two supply stacks 2, 3 are each resting on a pivotable bottom 5, each of which is loaded by a spring 6. The two supply stacks 2, 3 along with the respective pivotable bottoms 5 are each held by a laterally adjustable, V-shaped support 21, 23. The holders 21, 23 are so located with respect to the platen 10 that the feed paths of the copy elements thereon, being fed by respective rollers 7, 8, are of identical lengths. The uppermost sheet of each supply stack 2, 3 rests against a drivable separating roller 7, 8 in frictional engagement. In the vicinity of the lowermost edge of the supply stack, each stack has a corner separator 9 known per se, having at its corners the shape of a short protruding tab and forcing the uppermost sheet, when it is fed, or moved forward, to protrude beyond this corner, thereby preventing feeding of two of the same kind of sheet at a time. To enable single sheets to be fed manually into the printer, a funnel 11 is provided, embodied by guide plates 16. The separating rollers 7, 8, at least the jacket of which is of soft rubber, are each mounted on a shaft 12, 14, via a respective overrunning, or free wheeling connection 13, such that when the uppermost sheet is withdrawn these separating rollers 7, 8 can rotate without simultaneously positively driving the drive shafts 12, 14. The rotational movement of these drive shafts 12, 14 is derived from the platen 10, on the shaft of which is mounted a gear 18, which via an intermediate gear 20 drives a further gear 22, which is mounted on a shaft 24. A further gear 26 is also rigidly secured on the shaft 24, and on the same shaft 24 are also two drive rollers 28 mounted in a rotationally fixed manner, which deliver the sheets discharged from the platen to the output bin 4. The intermediate gear 20, the gear 22 and the shaft 24 are located on an intermediate frame 30, which can be mounted as a separable unit on the shaft of the printer 19 and removed from it as well. This intermediate frame permits ready adaptation to various brands and types of printers. In the mounted state of the intermediate frame 30, the intermediate gear 20 engages the gear 18 mounted on the shaft of the platen 10. On the other side, the unit 15 shown in FIGS. 1 and 2 can be removably mounted on the intermediate frame 30, the gear 26 of the intermediate frame 30 being coupled with the drive wheel 32. Recesses 34 are provided on both the side panels of the intermediate frame 30 and the side panels 25 of the unit 15 that is to be placed upon it, so as to permit engagement with the appropriate shaft.

The drive gear 32, via a clutch 45, 80 (see FIG. 4) and a toothed belt 36 and gear wheel 39, drives a first gear 38 (FIG. 2), rotatably supported on the shaft 14. A second gear 40, of the same size and rotatably supported on the shaft 12, meshes with the first gear 38. One ratchet 42, 44 is rigidly connected to each of the shafts 12, 14 and one latch 46, 48 (FIGS. 5–7) is capable of engaging each ratchet 42, 44. These latches 46, 48 are each pivotably supported on a respective gear 38, 40 and are spring loaded in the direction of the associated ratchet 42, 44. A respective deflection latch 55, 56 is pivotably supported on each side wall 25 and is intended for cooperation with the latches 46 and 48, respectively. These deflection latches 55, 56 are spring loaded such that each rests against a respective stop 58, 60 integral with the housing. A positioning wheel 50, 52 is connected in a rotationally fixed manner with each ratchet 42, 44 and is provided on its circumference with a notch 62, 64 which is engaged by a stay element 66. This substantially T-shaped stay element 66 is embodied such that its upper middle part 70 is pivotable, relative to the locking element 68 extending transversely thereto, about a pin 73 protruding through an oblong slot 69 in the middle part and is additionally movable in the oblong slot in the longitudinal direction relative to the middle part 70. Located at the ends of the middle part 70 are rollers 71, 72, each of which engages a notch 62, 64 of these positioning wheels 50, 52. The middle part 70 is urged downward by springs 67 (FIG. 4), so that it can selectively pivot about one of the rollers 71, 72. The locking element 68 is urged by a further spring 75 in the direction of the clutch 45, 80. The lower end of the locking element 68 of this stay element 66 rests against an eccentric element 74, which actuates the clutch 45, 80.

Figure 4:
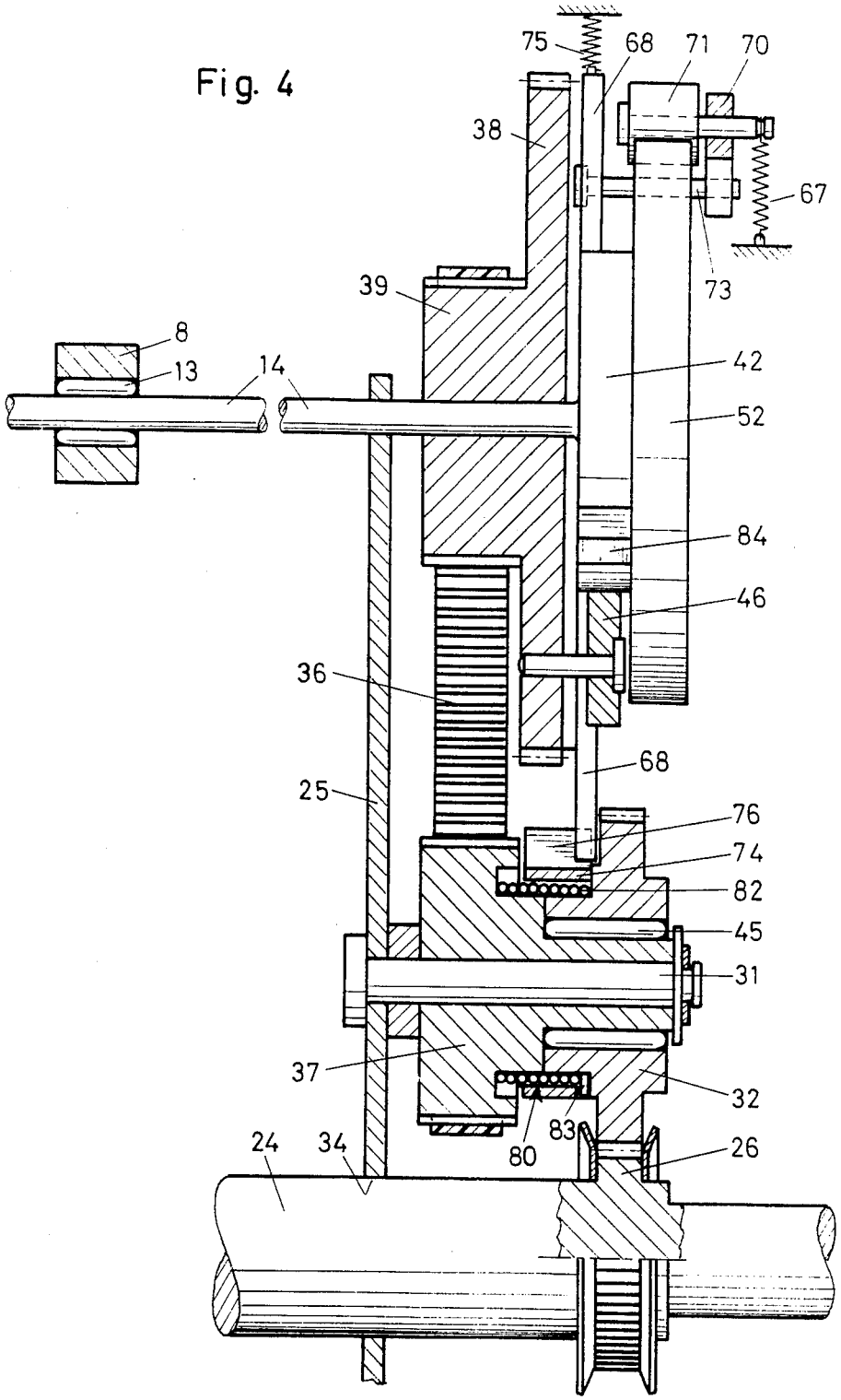

As shown in FIG. 4, the drive wheel 32 is joined to the belt roller 37 via a spiral spring clutch 80. This spiral spring clutch 80 is of an embodiment known per se and includes a spiral spring 82, which with one end 83 engages the eccentric element 74. In one rotational direction the spring 82 acts as a free wheeling element and in the other rotational direction it acts as a friction clutch which connects the drive wheel 32 to the belt roller 37 by friction as long as the eccentric element 74 is not arrested by means of the contact of one shoulder 76 with the locking element 68. Between the bearing bolt 31 and the drive wheel 32, there is also an overrunning, or free wheeling connection 45, which locks in the direction opposite the spiral spring clutch 80.

Figure 2:
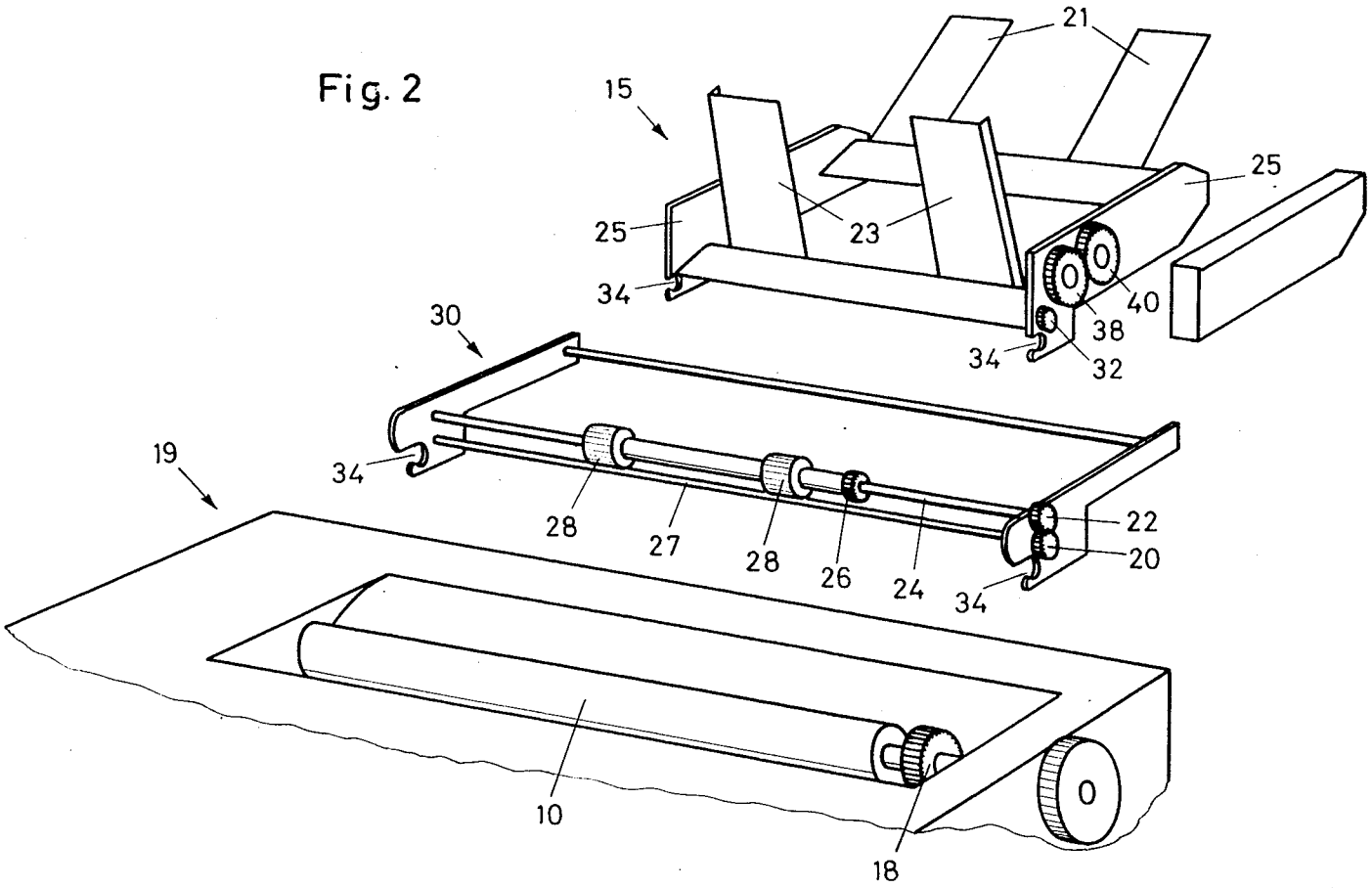
Figure 5:
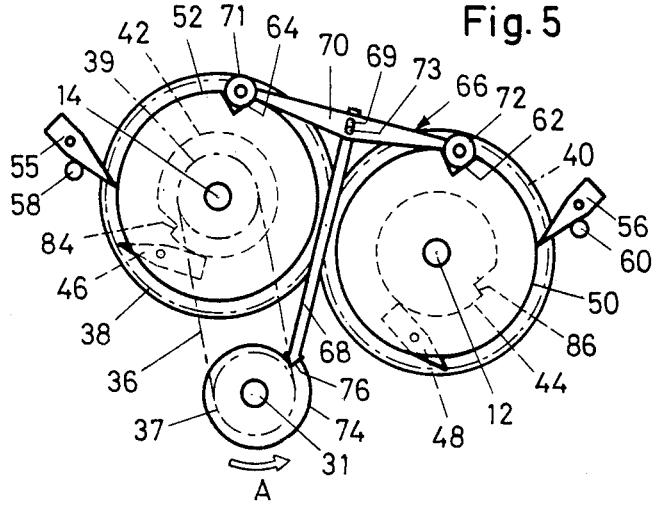
Figure 6:
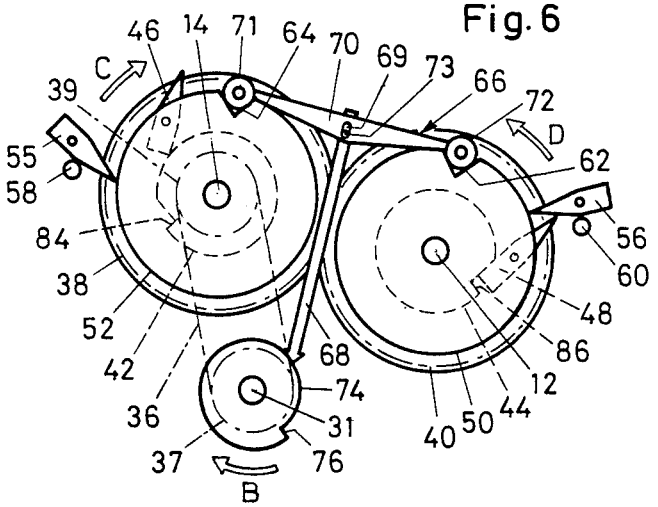
Figure 7:
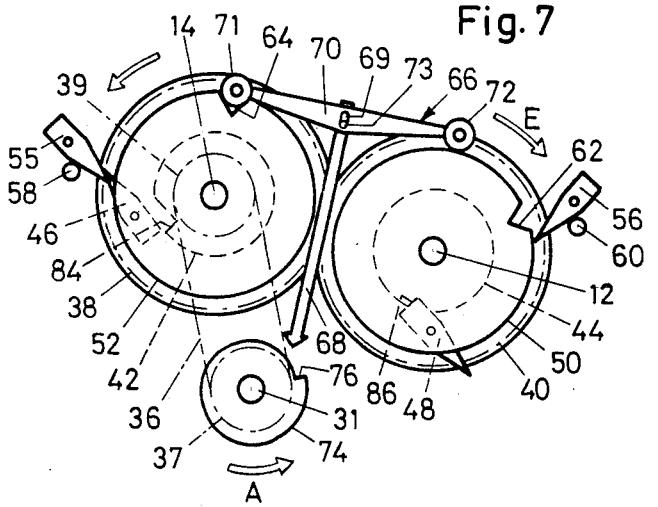

Operation, with reference to FIGS. 5-7:

When the platen 10 (FIG. 2) rotates in the sheet feed direction—that is, the direction of the arrow V in FIG. 1—this rotation is transmitted to the gears 18, 20, 22 and 32. This rotation corresponds to a rotation which is identical to the rotational direction A of FIG. 5. Since the stay element 66 strikes the eccentric element 74, the spiral spring clutch 80 is disengaged, so that the belt roller 37 is stopped.

Now if a sheet is to be drawn from one of the two supply stacks 2 or 3, this operation is initiated by rotating the platen 10 in reverse, after the previously printed sheet has been deposited in the output bin 4. The selection of whether a sheet is to be taken from the supply stack 2 or 3 is determined by a variable angle of rotation during the reverse rotation—that is, counter to the forward or sheet feeding direction. To this end, the printer or the like is programmed accordingly. FIG. 5 shows the initial position, and A represents the sheet feeding direction.

As soon as the platen 10 is rotated in reverse—that is, counter to the sheet feeding direction—the drive wheel 32 moves in the direction of the arrow B (FIG. 6). Via the overrun free wheeling element 45, the gear 37 is rotated, which drives the toothed belt 36. The toothed belt 36 drives the upper belt wheel 39, which is mounted loosely on the shaft 14 and is rigidly connected with the gear 38. A pivotable, spring loaded latch 46 is supported on this gear 38. Upon rotation in the direction of the arrow B, the latch 46 travels unhindered past the spring loaded deflection latch 55. The gear 38, rotating in the direction of the arrow C, meshes with the same-sized gear 40, which is rotating in the direction of the arrow D. As a result of this rotation, the latch 48, resting resiliently against the ratchet 44, comes to rest against the shoulder 86. If the direction of rotation is now reversed, that is, if a sheet is to be introduced in the sheet feed direction according to the arrow V in FIG. 1, then the rotation causes the ratchet 44, together with the separating roller 7 mounted on the shaft 12, to rotate in the direction of the arrow E (FIG. 7). As a result, the stay element 66 is pivoted about the roller 71, which acts as a pivot, because the roller 72 moves out of the notch 62 since the positioning wheel 50 is rotating together with the gear 40. As a result of this raising of the stay element 66, its locking element 68 is disengaged from the eccentric element 74. Thus the separating roller 7 mounted on the shaft 12 is now driven via the spiral spring clutch 30 and feeds a sheet in the direction toward the platen 10. As shown in FIG. 7, the latch 46 is thereupon raised beyond the shoulder 84 by the deflection latch 55, so that the shaft 14 is not driven. After one full revolution of the positioning wheel 50 has been completed, the roller 72 returns into the notch 62, causing the stay element 66 to assume its position shown in FIG. 5. At the same time, the latch 48 is raised above the shoulder 86 by its contact with the deflection latch 56, causing the drive of the shaft 12 to be interrupted. As rotation continues, the locking element 68 comes to rest against the eccentric element 74, thereby breaking off the frictional connection of the spiral spring clutch 80. This sheet feeding movement is large enough that the sheet is grasped by the platen 10, which then advances the sheet further, line by line, during the printing operation. The separating roller now rotates without positive drive of the shaft 12 via the overrunning gear 13.

Contrarily, if the other separating roller 8 is to be driven, this is accomplished in that the reverse rotation of the platen 10 counter to the sheet feeding direction is performed about a smaller angle of rotation. Beginning at the position of the gearing shown in FIG. 5, the reverse rotation of the platen 10 causes the drive wheel 32 and thus the toothed belt 36 and the upper belt wheel 39 together with the gear 38 to be driven counter to the direction of the arrow A. As a result, the latch 46 mounted on the gear 38 rotates as well. The ratchet 42 and the positioning wheel 52 along with it remain stationary at first. As soon as the latch, which is pressed by spring loading toward the center of the gear 38, reaches the vicinity of the shoulder 84, this latch 46 locks into place. The reverse rotation is now interrupted. Any slight further movement that might take place has the effect solely of raising the deflection latch 55 somewhat, which only increases the force pressing the latch 46 against the ratchet 42. If subsequently the platen 10 is again rotated in the sheet feeding direction, the effect is that the latch 46 rotates the ratchet 42 as well, and as a result drives the separating roller 8 mounted on the shaft 14. Since the positioning wheel 52 is thereby driven with it, the roller 71 of the stay element 66 moves out of the notch 64 of the positioning wheel 52, causing the locking element 68 of the stay element to be disengaged from the eccentric element 74. Now as soon as a complete revolution has taken place, the roller 71 drops back into the notch 64 of the positioning wheel 52, and as a result the eccentric element 74 is arrested by the locking element 68, and the spiral spring clutch 80 is disengaged. In the meantime, however, the sheet that is to be printed has entered the insertion gap of the platen, which then grasps the sheet and transports it further. Since the separating rollers are provided with an overrunning gear, or free wheeling connection, the shaft 14 no longer needs to be positively driven.

Because of the V-shaped arrangement of the two supply stacks 2, 3, the distance to the insertion gap of the platen 10 is the same for both stacks, which simplifies the control of the selective sheet feeding.

By means of the disengageable spiral spring clutch 80 in cooperation with the stay element 66, the two gears 38, 40 are always in the same position at the beginning of an insertion or sheet feeding operation, regardless of the angle of rotation previously executed by the platen 10 in the sheet feeding direction V.

In the exemplary embodiment described above, two supply stacks 2, 3 are provided. However, the invention is equally applicable to apparatus having only a single stack. In that case, the stack 2, for instance, and the associated separating roller 7, shaft 12, gear 40, ratchet 44, latch 48, deflection latch 56 and positioning wheel 50 could be omitted, and the middle part 70 would then be pivotably secured, in place of the roller 72, on the side wall 25.

If three supply stacks are to be provided, for example one stack for letterheads, one for blank sheets and a further stack for envelopes to be addressed, then a further separating roller and associated gear, ratchet and positioning wheel can be provided for the third supply stack. Instead of the middle part 70, a balancing beam arrangement, for example, could be provided, so that the locking element 68 can be raised by all three positioning wheels.

Figure 8:
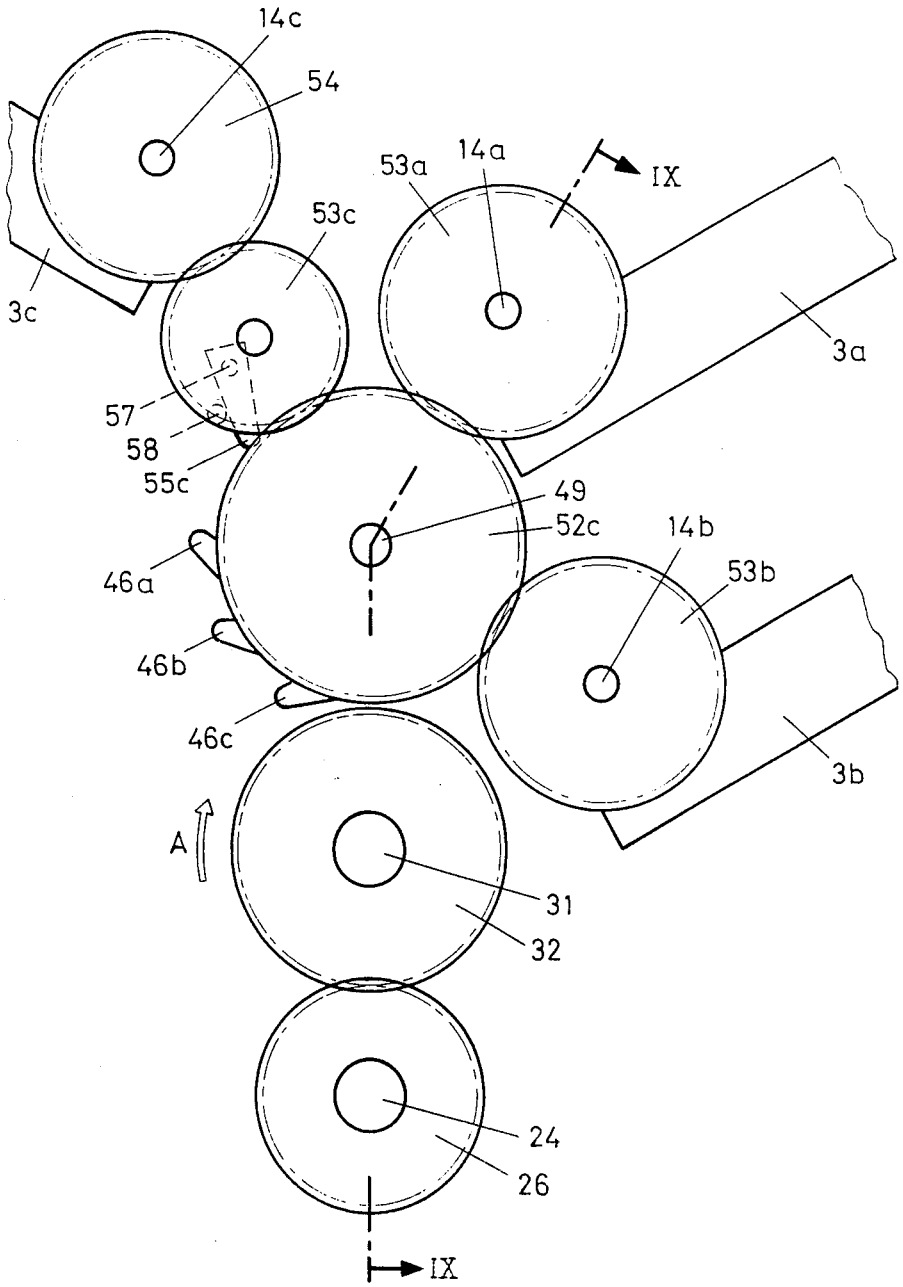
Figure 9:
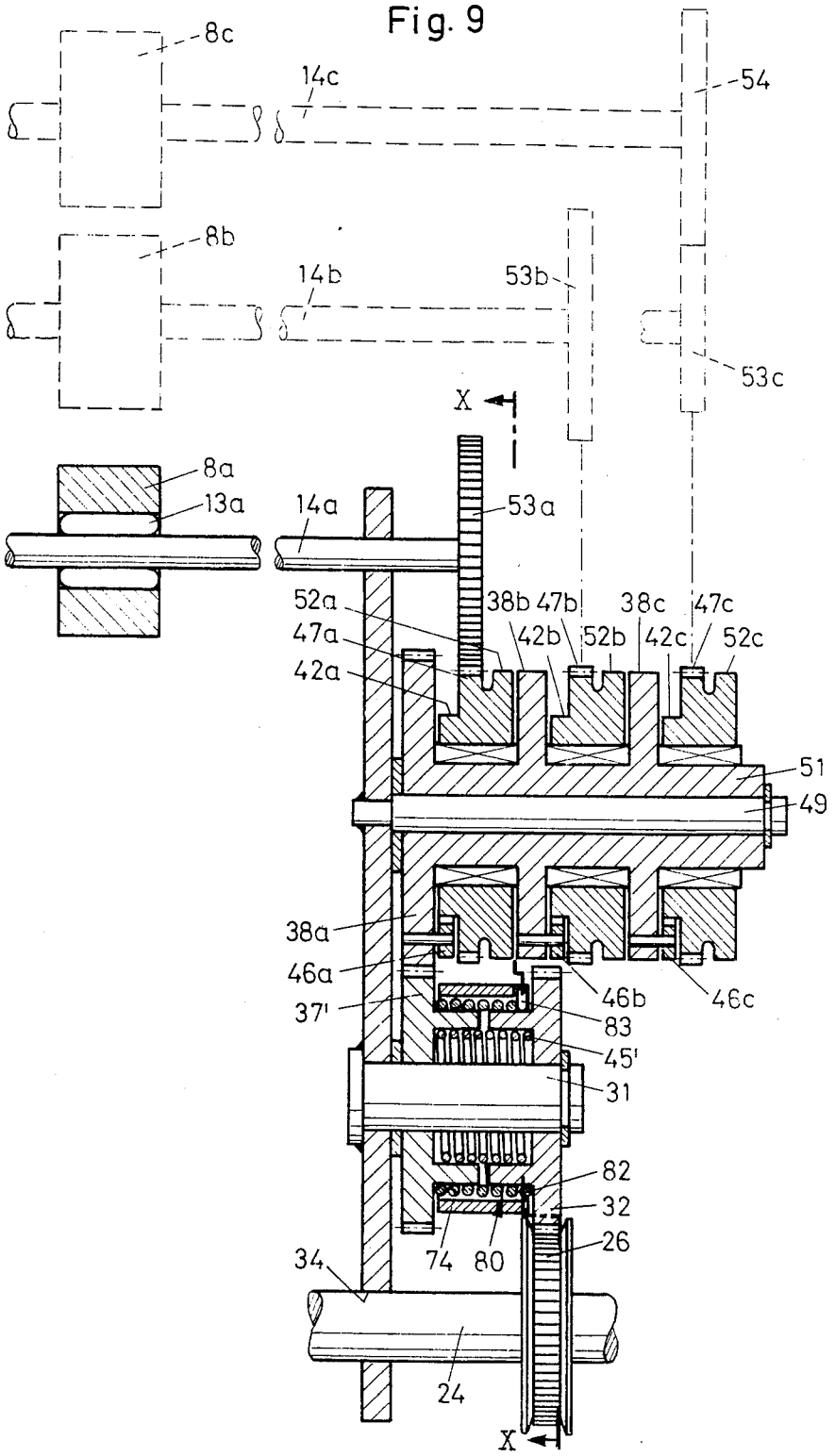
Figure 10:
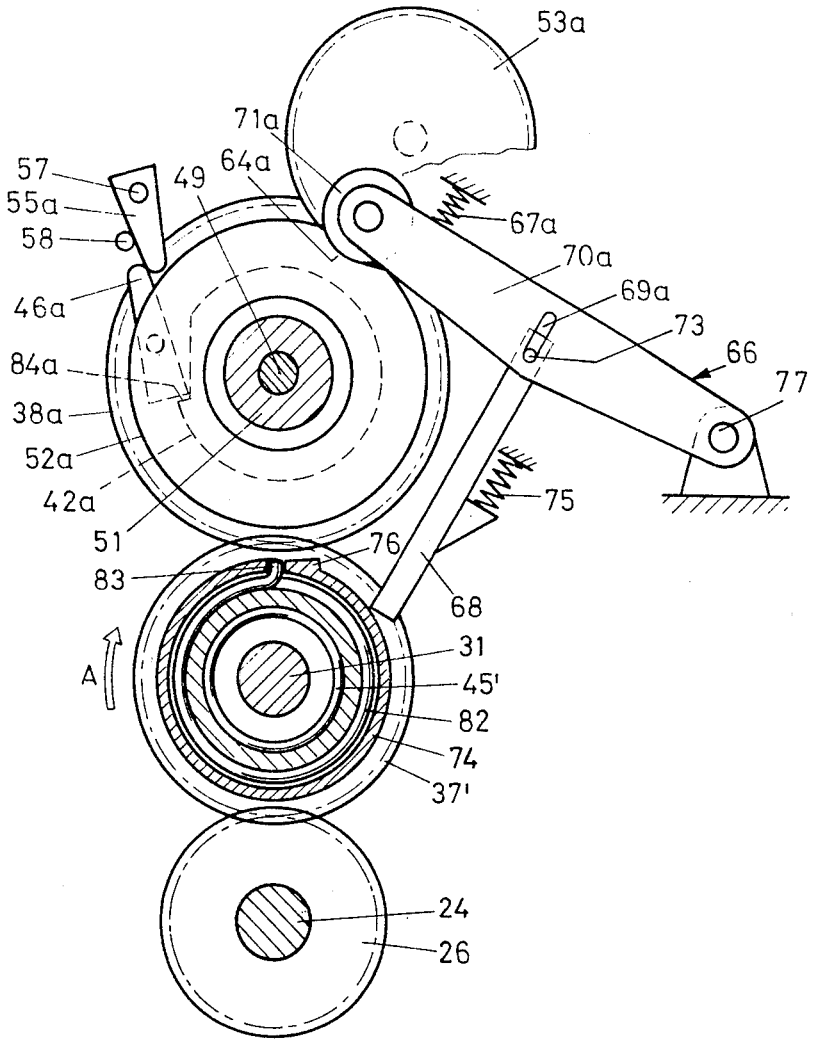

FIGS. 8–10 show a further exemplary embodiment having three supply stacks 3*a*, 3*b*, 3*c*; again, this apparatus comprises an intermediate frame and a unit mountable on it. The intermediate frame is embodied analogously to the first exemplary embodiment. For the sake of clarity, only the shaft 24 and the gear 26 of this intermediate frame are shown here.

The drive wheel 32 again meshes with the gear 26 and is joined via the clutch 80, 45' with a gear 37', which corresponds to the belt roller 37 of the first exemplary embodiment. The overrunning gear, or free wheeling connection, is embodied here as a spiral spring clutch 45', and it locks when rotation is counter to the sheet feeding direction. The second spiral spring clutch 80 is identical to that of the first embodiment and it locks in the sheet feeding direction, as long as it is not disengaged by the arresting of the eccentric element 74.

The three ratchet latch holders 38*a, b, c* are disposed coaxially with one another and are rigidly joined to one another via a sleeve 51. The ratchet latch holder 38*a* has teeth on its outside and meshes with the gear 37'. The sleeve 51 is rotatable on a bolt 49 integral with the housing. Associated with each ratchet latch holder 38*a, b, c* is a ratchet 42*a, b, c*; a positioning wheel 52*a, b, c* rigidly connected with the ratchet 42*a, b, c*; and a gear 47*a, b, c*. These gears 47*a, b, c* each mesh with a further gear 53*a, b, c*. The gears 53*a* and 53*b* are rigidly connected with the associated shafts 14*a*, 14*b* of the separating rollers 8*a*, 8*b*, and the separating rollers 8*a, b* again have overrunning gears 13*a, b*. The gear 53*c* is an intermediate gear, which drives a further gear 54 connected with the shaft 14*c*. The third separating roller 8*c* is supported on the shaft 14*c*.

The supply stacks 3*a*, 3*b* associated with the separating rollers 8*a*, 8*b* are disposed one above the other, while the third supply stack 3*c* is located opposite them, as shown schematically in FIG. 8. For the sake of clarity, the stay element 66 and the side wall 25 have been left out in FIG. 8.

The three deflection latches 55*a, b* and *c* are pivotably supported on a common pin 57 (FIG. 10) integral with the housing and are each pressed by a respective spring, not shown, against a common stop pin 58 integral with the housing. The three associated latches 46*a, b, c,* each being pivotably supported on one of the ratchet latch holders 38*a, b, c,* are offset from one another at an angle in the basic position (FIG. 8), so that the reverse rotational angle by which the platen must rotate in order for the latches 46*a, b, c* to lock into place in the associated ratchets 42*a, b, c* is different for each of the three ratchets 42*a, b, c.* In FIG. 9, for the purposes of illustration, the pivot shafts of the latches 46*a, b, c* are rotated into the plane of the drawing.

The stay element 66 (FIG. 6) here comprises a locking element 68 supported in a longitudinally displaceable manner and urged by a spring 75 in the direction of the eccentric element 74; a pin 73 is secured on the locking element 68. One pivoting lever 70*a, b, c* is associated with each of the positioning wheels 52*a, b, c* and the pivot levers 70*a, b, c* are supported at one end on a common pin 77 integral with the housing. At the other end, they each bear a roller 71*a, b, c* which rolls off on the associated positioning wheel 52*a, b, c.* The pivot levers 70*a, b, c* are loaded by a spring 67*a* and by similar springs 67*b,* 67*c* (not seen in FIG. 10) and each have an oblong slot 69*a, b, c* which is engaged by the pin 73. The locking element 68 is thereby raised, as soon as one of the three positioning wheels 52*a, b, c* is rotated, and so the associated roller 71*a, b, c* is thereby raised up out of the notch 64*a, b, c.*

Operation, with reference to FIGS. 8–10:

Operation is analogous to that of FIGS. 1–7, but the forward rotational direction A of the drive wheel 32 is reversed. As rotation in the forward direction A continues, the shoulder 76 of the eccentric element 74 rests on the locking element 68, so that the spring clutch 80 is disengaged and the gear 37' does not rotate. The apparatus is in the basic position shown in FIG. 8. If the platen is now rotated in reverse, then first the latch 46*a* assumes the position shown in FIG. 10, in which it engages the shoulder 84*a* of the ratchet 42*a.* If the platen is then rotated forward, then as in the first exemplary embodiment the latch 42*a* and hence the gears 47*a,* 53*a,* the shaft 14*a* and the separating roller 8*a* rotate as well, so that a sheet is delivered from the supply stack 3*a* to the platen. The pivoting arm 70*a* is raised by the positioning wheel 52*a* and carries the locking element 68 with it. This movement is interrupted after one revolution of the ratchet latch holder 38*a,* when the latch 46*a* meets the deflection latch 55*a.* At the same time, the roller 71*a* enters the notch 64*a,* so that as the gear 32 continues to rotate, the shoulder 76 meets the locking element 68, and the basic position has once again been attained.

The other two separating rollers 8*b,* 8*c* are driven by means of appropriately larger angles of reverse rotation.

In the exemplary embodiment of FIGS. 8–10, it is readily possible to omit the third supply stack 3*c* and the associated separating roller 8*c,* shaft 14*c,* gears 54, 53*c,* 47*c* and the ratchet latch holder 38*c,* ratchet 42*c,* positioning wheel 52*c* and pivot arm 70*c* in accordance with the wishes of a customer, that is, to manufacture apparatuses having a variable number of supply stacks with one basic embodiment. This simplifies both manufacture and warehousing.

Figure 11:
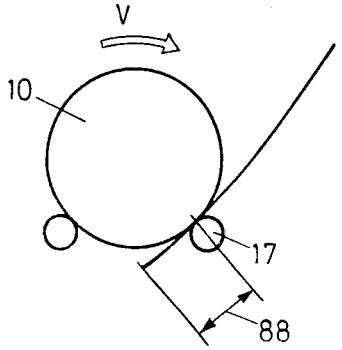
Figure 12:
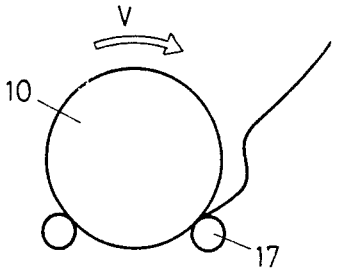

Once the sheet that is to be introduced is grasped between the platen 10 and the first pressure roller 17 (FIG. 1), that is, once the associated separating roller 7, 8 has made one complete revolution, the sheet protrudes beyond the pressure roller 17 by a certain length 88 (FIG. 11). In order to increase the accuracy of register, or alignment, it is possible first to rotate the platen in reverse, counter to the sheet feeding direction V, by a length longer than the length 88, so that the sheet reemerges at the back from the gap between the platen 10 and the pressure roller 17 (FIG. 12), and only then to feed the sheet in its fianl alignment. Since the front edge of the sheet is then gripped at a precisely defined point on the circumference of the platen, high accuracy of registration, or alignment, is attainable without having to demand great precision of the apparatus itself.

I claim:

1. For combination with an office writing machine (19) having a platen (10) rotatable in a forward sheet feeding direction (A) and in a reverse sheet aligning direction (B), apparatus for feeding single copy elements from a stack (2, 3) of sheets having separating rollers (7, 8) in engagement with a topmost sheet of the stack of sheets;

drive means (42, 46; 44, 48) including gearing and an overrunning clutch (13) coupled to the separating rollers for driving the separating rollers to feed the topmost sheet to the platen, the overrunning clutch permitting grasping of the sheet by the platen and pulling the sheet while the separating rollers spin freely, and a slip-free coupling element (20) coupled to the platen (10) and rotatable therewith in either direction, and further coupled to the drive means to rotate the gearing of the drive means upon rotation of the platen, wherein, in accordance with the invention, the gearing includes means (46, 84) for engaging the coupling element (20) with the separating rollers (7, 8) upon rotation of the platen (10) over a predetermined first angle in the reverse direction;

means (42) for driving the separating rollers (7, 8) after engagement of the coupling element (20) with the separating rollers (7, 8) upon subsequent rotation of the platen (10) over a predetermined second angle in the forward direction; and means (55) for disengaging the coupling element (20) from the separating rollers (7, 8) after rotation of the platen (10) in the forward direction over the second angle.

2. Apparatus according to claim 1 wherein said means for engaging and the means for driving include a ratchet wheel (42, 44) having a shoulder (84, 86), and coupled to rotate with the overrunning clutch (13);

a ratchet latch holder (38, 40) coupled to be driven by the coupling element (20);

a biassed ratchet latch (46, 48) secured to the ratchet latch holder (38, 40) and arranged to engage with said shoulder (84, 86) upon rotation of the platen (10) in reverse direction by the first angle, said ratchet latch (46, 48), upon subsequent rotation of the platen in the forward direction engaging the ratchet wheel (42, 44);

and wherein the means for disengaging comprises a deflection element (55, 56) positioned for lifting the ratchet latch (46, 48) over and above said shoulder (84, 86) upon rotation of the platen (10) in the forward direction over said second angle.

3. Apparatus according to claim 2, further including a clutch coupling (45, 80) connecting the ratchet latch holder (38, 40), and the coupling element (20), said clutch coupling providing for rotation transmission upon rotation of the platen in said forward direction and for free wheeling in the reverse direction;

a biassed stay element (66) engageable with the clutch coupling, the stay element (66) engaging the clutch coupling to release rotation transmission upon movement of the stay element and further including a positioning wheel (50, 52) coupled to the ratchet wheel (42, 44) having a positioning discontinuity (62, 64) formed thereon and controlling movement of said stay element (66) for release of rotation transmission by said clutch coupling.

4. Apparatus according to claim 3 wherein said clutch coupling (45, 80) comprises a free wheel coupling (45) and a spring clutch (80);

and an eccenter (74) coupled for control by said stay element and, upon movement of said stay element, releasing the spring clutch coupling (80).

5. Apparatus according to claim 1 wherein two stacks (2, 3) are provided, each stack having a separating roller (7, 8) associated therewith;

an overrunning clutch (13) associated with each stack;

and wherein said means for driving the separating rollers are responsive to a predetermined angular extent of rotation of the coupling element (20), the angular extent of rotation of the coupling element for driving the separating roller (7) of one of the stacks (2) for feeding a copy element therefrom being different from the angular extent of rotation of the coupling element (20) for driving the separating roller (8) of the other stack for feeding a copy element from the other stack (3).

6. Apparatus according to claim 3 wherein two stacks (2, 3) are provided, each stack having a separating roller (7, 8) associated therewith;

an overrunning clutch (13) associated with each stack;

a ratchet latch holder (38, 40) coupled to be driven by the coupling element (20) associated with each stack;

a ratchet wheel (42, 44) having a shoulder (84, 86) associated with each stack, and coupled to rotate with the respective overrunning clutch;

a biassed ratchet latch (46, 48) secured to the ratchet latch holder (38, 40) of each stack;

and a deflection element (55, 56) associated with each stack, and positioned for engagement by the respective latch over and above the respective shoulder (84, 86);

and wherein the latch carrier (38) associated with one of the stacks (8) is coupled in rotation transmitting relation with the latch holder (40) associated with the separating roller (8) of the other one of the stacks (3);

and wherein two positioning wheels (50, 52) are provided, coupled to the ratchet wheel associated with the respective stack, each one of the positioning wheels having a positioning discontinuity (62, 64) formed thereon, and, respectively selectively each controlling movement of said stay element (66).

7. Apparatus according to claim 6 wherein said clutch coupling (45, 80) comprises a free wheel coupling (45) and a spring clutch (80);

an eccenter (74) coupled for control by said stay element and, upon movement of said stay element, releasing said clutch coupling (80);

and wherein said stay element comprises a locking portion (68) acting on the eccenter (74) and an engagement portion (70) movable to a limited degree with respect to the locking portion being positioned in engagement with the positioning wheels (50, 52) for biased engagement therewith, and, selectively, engagement with the respective positioning discontinuities (62, 64) on the positioning wheels.

8. Apparatus according to claim 5 further including holders (21, 23) for retaining the respective stacks (2, 3);

said holders being positioned with respect to the platen (10) such that the feed path of a copy element being fed by the respective separating rollers (7, 8) from either stack is of identical length.

9. Apparatus according to claim 2 wherein a plurality of stacks of sheets (3*a*, 3*b*, 3*c*) are provided, each having a separating roller (8*a*, 8*b*, 8*c*) associated therewith;

an overrunning clutch (13*a*, 13*b*, 13*c*) associated with each separating roller (8*a*, 8*b*, 8*c*);

and wherein the predetermined angular extent of the reverse direction for feeding a sheet by a respective separating roller (8*a*, 8*b*, 8*c*) from a selected stack is different from that of any other stack, and associated with a specific selected stack.

10. Apparatus according to claim 9 wherein a plurality of ratchet latch holders (38*a*, 38*b*, 38*c*) are provided, each associated with a respective separating roller (8*a*, 8*b*, 8*c*), and rigidly connected together;

ratchet weheels (42*a*, 42*b*, 42*c*) associated with each ratchet holder (38*a*, 38*b*, 38*c*) and rotatable with respect to the respective ratchet holder (38*a*, 38*b*, 38*c*)' and a plurality of deflection elements (55*a*, 55*b*, 55*c*) are provided, one each associated with a respective ratchet latch holder (38*a*, 38*b*, 38*c*).

11. Apparatus according to claim 10 further including a positioning wheel (52*a*, 52*b*, 52*c*) coupled to the respective ratchet wheels (42*a*, 42*b*, 42*c*), each positioning wheel having a respective positioning discontinuity (64*a*, 64*b*, 64*c*) formed thereon;

a one-way clutch coupling (45', 80) connecting the ratchet latch holder (38*a*, 38*b*, 38*c*) and the coupling element (20);

and a biassed stay element (66) engageable with the clutch coupling, the stay element (66) engaging the clutch coupling to release rotation transmission upon movement of the stay element;

and wherein the stay element is positioned in engagement relation with respect to the positioning discontinuity (64*a*, 64*b*, 64*c*) of the respective positioning wheel (52*a*, 52*b*, 52*c*) and movable by the respective positioning wheel.

12. Apparatus according to claim 11 wherein said clutch coupling (45, 80) comprises a free wheel coupling (45) and a spring clutch (80);

an eccenter (74) coupled for control by said stay element and, upon movement of said stay element, releasing said clutch coupling (80);

and wherein said stay element comprises a locking portion (68) acting on the eccenter (74) and an engagement portion (70) movable to a limited degree with respect to the locking portion being positioned in engagement with the positioning wheels (50, 52) for biassed engagement therewith, and, selectively, engagement with the respective positioning discontinuities (62, 64) on the positioning wheels.

13. Apparatus according to claim 12 further comprising a plurality of springs (67*a,* 67*b,* 67*c*) engaging respective stay elements (70*a,* 70*b,* 70*c*) and biassing the respective stay elements against the associated positioning wheel (52*a,* 52*b,* 52*c*).

14. Apparatus according to claim 1 wherein the apparatus includes a separating frame (30) releasably selectively attachable to said writing machine, said separating frame having said coupling element (20) secured thereto for engagement with said platen; and a coupling frame (15) forming a separable unit, and separably engageable with said separating frame, said coupling frame supporting and having secured thereto holder means (21, 23; 3*a,* 3*b,* 3*c*) for said stack of sheets, the separating rollers, the drive means, and the overrunning clutch (13).

15. Apparatus according to claim 6 wherein the shoulders (84, 86) of the respective ratchet wheels (42, 44) are located at respectively different positions with respect to a datum or rest position to be respectively engaged by respectively different angular extents of rotation of the coupling element (20) upon rotation of the platen (10) in the reverse, or sheet aligning direction, to thereby select rotation of a respective one of the separating rollers, and hence feeding of a copy element from a selected one of the stacks in dependence on a selected angular extent of rotation of the platen in the reverse, or sheet aligning direction.

* * * * *